US011815080B2

(12) United States Patent
Chou et al.

(10) Patent No.: US 11,815,080 B2
(45) Date of Patent: Nov. 14, 2023

(54) PISTON OF CYLINDER OF AIR COMPRESSOR

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 0 days.

(21) Appl. No.: 17/709,134

(22) Filed: Mar. 30, 2022

(65) Prior Publication Data

US 2022/0341408 A1 Oct. 27, 2022

(30) Foreign Application Priority Data

Apr. 21, 2021 (TW) ..... 110114426

(51) Int. Cl.
*F04B 39/00* (2006.01)
*F04B 37/10* (2006.01)
*F04B 53/12* (2006.01)

(52) U.S. Cl.
CPC ..... *F04B 39/0016* (2013.01); *F04B 53/123* (2013.01)

(58) Field of Classification Search
CPC F04B 39/0016; F04B 53/123; F04B 39/1033; F04B 39/14; F04B 53/12; F04B 39/0005
See application file for complete search history.

(56) References Cited

U.S. PATENT DOCUMENTS 43,826 A * 8/1864 Baldwin ..... F04B 39/0016 417/553
4,275,999 A 6/1981 Hetzel et al.
5,163,819 A * 11/1992 Pettitt ..... F04B 27/1009 417/269
5,452,994 A 9/1995 Erickson
10,288,054 B2 * 5/2019 Lim ..... F04B 39/10
(Continued)

FOREIGN PATENT DOCUMENTS

DE 2734862 2/1979
DE 60309280 2/2007
(Continued)

OTHER PUBLICATIONS

"Search Report of Europe Counterpart Application", dated Aug. 23, 2022, p. 1-p. 8.
(Continued)

*Primary Examiner* — Bryan M Lettman
(74) *Attorney, Agent, or Firm* — JCIPRNET

(57) ABSTRACT

A piston of an air compressor contains at least one fixing bolt configured to fix a plane of a top of a head of the piston to at least one air stop sheet. A respective one of the at least one air stop sheet includes at least one bending section and at least one acting zone surrounding the at least one bending section and configured to cover at least one air orifice. A back surface of the at least one acting zone of the respective one air stop sheet moves away from the plane of the top of the head at an open angle θ, thus producing an air flowing space. A pressure of a cylinder balances with atmosphere, and the piston is not stopped by a back-pressure resistance to move smoothly in upward and downward moving strokes after the air stop sheet moves again.

7 Claims, 12 Drawing Sheets

(56) References Cited

U.S. PATENT DOCUMENTS

| | | | | |
|---|---|---|---|---|
| 2004/0146418 | A1* | 7/2004 | Kang | F04B 39/0016 417/549 |
| 2004/0179965 | A1* | 9/2004 | Yoon | F04B 39/0016 417/416 |
| 2005/0013717 | A1* | 1/2005 | Lee | F16K 15/148 417/570 |
| 2005/0047947 | A1 | 3/2005 | McCombs et al. | |
| 2006/0045770 | A1* | 3/2006 | Chuang | F04B 39/1066 417/416 |
| 2012/0036993 | A1* | 2/2012 | Nieter | F16K 15/031 91/468 |
| 2015/0377227 | A1 | 12/2015 | Muhle et al. | |
| 2020/0309103 | A1 | 10/2020 | Todman | |

FOREIGN PATENT DOCUMENTS

| | | |
|---|---|---|
| JP | 3237933 | 6/2022 |
| KR | 20050071260 | 7/2005 |

OTHER PUBLICATIONS

"Office Action of Japan Counterpart Application", dated Jun. 6, 2023, p. 1-p. 5.

* cited by examiner

PISTON OF CYLINDER OF AIR COMPRESSOR

FIELD OF THE INVENTION

The present invention relates to an air compressor, and more particularly to the air compressor which includes a piston and a head moving upward and downward in a cylinder of the air compressor.

BACKGROUND OF THE INVENTION

A conventional air compressor contains: a motor, a piston driven by the motor to move reciprocately in a cylinder, such that airs are compressed to produce compressed airs, and the compressed airs are delivered to a storage holder from the cylinder, thereafter the compressed airs are inflated into a deflated object via an output tube of the storage holder via a delivery hose connected with the output tube. The piston includes a conduit communicating with a head thereof, an air stop sheet covered on the conduit of a plane of a top of the piston. When the air compressor stops, the air stop sheet closes the conduit of the head of the piston. After the air compressor operates again, airtightness produces among an airtight ring and the air stop sheet of the head of the piston and the air stop sheet, so the compressed airs cannot be discharged out of the cylinder completely. After starting the air compressor once more, the piston hit the compressed airs in the cylinder to increase loading and electric currents of the air compressor, thus reducing a service life of the air compressor.

The present invention has arisen to mitigate and/or obviate the afore-described disadvantages.

SUMMARY OF THE INVENTION

The primary aspect of the present invention is to provide a piston of an air compressor which contains at least one fixing bolt configured to fix a plane of a top of a head of the piston in at least one air stop sheet, a respective one of the at least one air stop sheet includes at least one bending section and at least one acting zone opposite to the at least one bending section and configured to cover at least one air orifice, and a back surface of the at least one acting zone of the respective one air stop sheet turns on relative to the plane of the top of the head at an open angle θ, thus producing an air flowing space; a pressure of a cylinder balances with atmosphere, and the piston is not stopped by a back-pressure resistance to move smoothly in upward and downward moving strokes after the air stop sheet moves again.

Another aspect of the present invention is to provide a piston of an air compressor which contains the bending section of the respective one air stop sheet having at least one collapsible guide line, and a number of the at least one collapsible guide line are determined based on an output power of the air compressor.

DETAILED DESCRIPTION OF THE PREFERRED EMBODIMENTS

Figure 1:
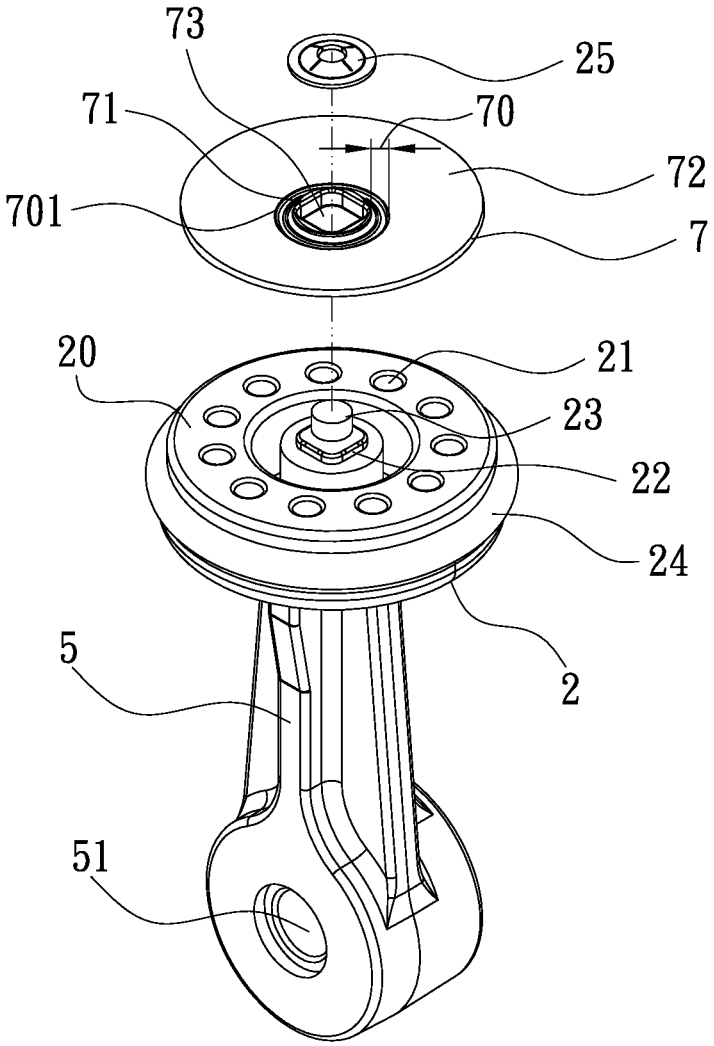
FIG. 1 is a perspective view showing the exploded components of a piston of an air compressor according to a preferred embodiment of the present invention.
Figure 2:
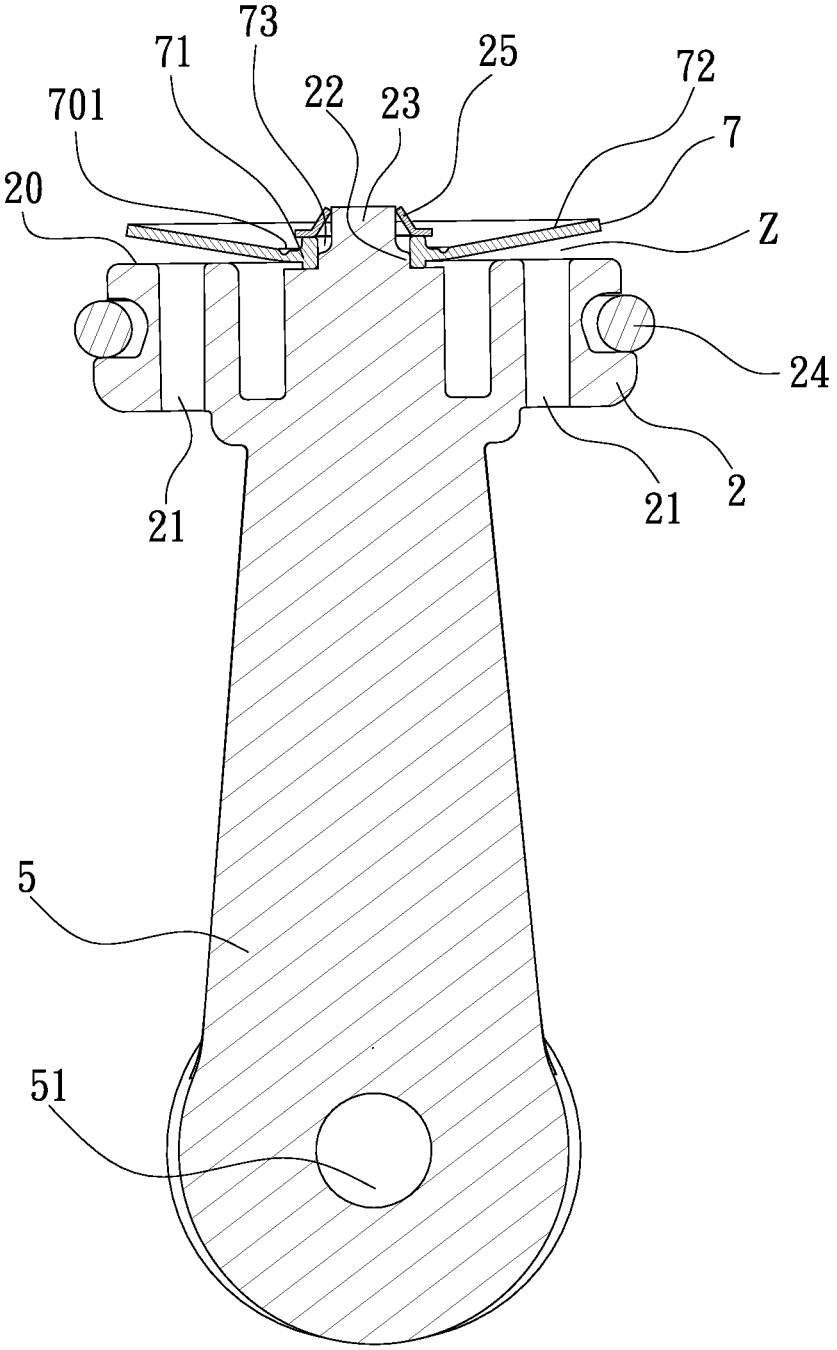
FIG. 2 is a cross sectional view showing the assembly of the piston of the air compressor according to the preferred embodiment of the present invention.
Figure 3:
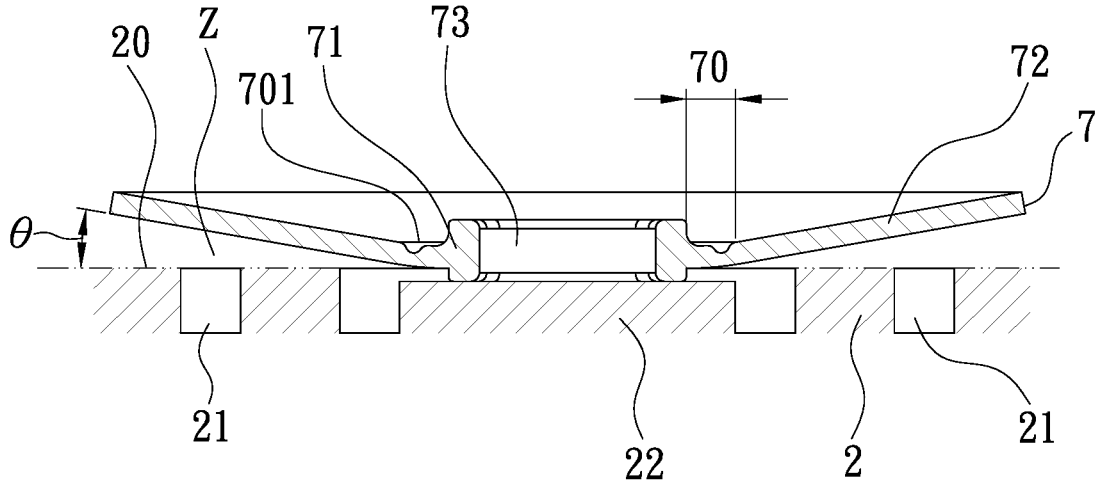
FIG. 3 is an amplified cross sectional view showing the assembly of a part of the piston of the air compressor according to the preferred embodiment of the present invention.
Figure 4:
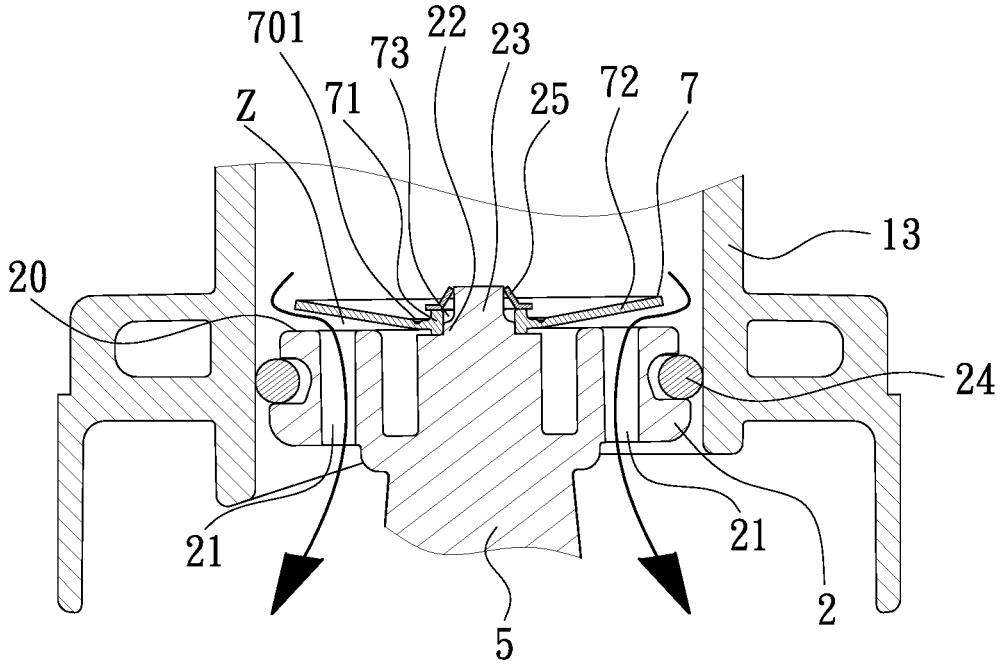
FIG. 4 is a cross sectional view showing the operation of the piston of the air compressor according to the preferred embodiment of the present invention.
Figure 5:
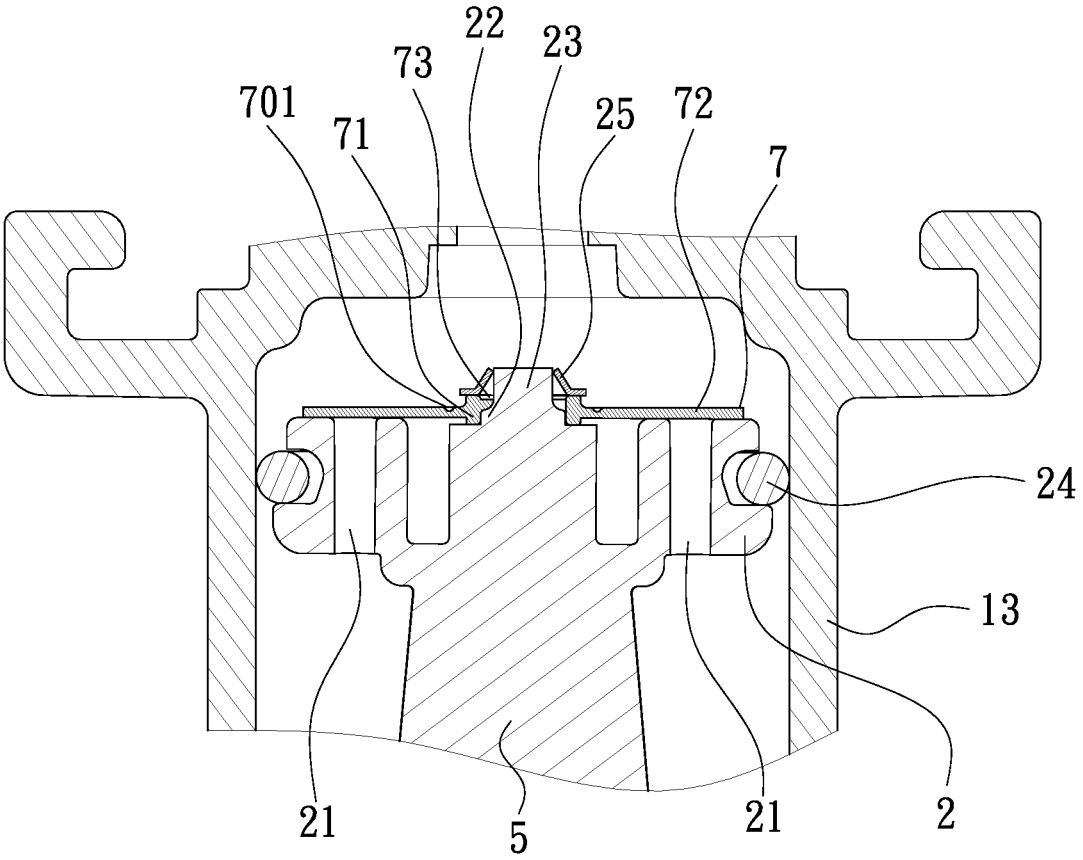
FIG. 5 is another cross sectional view showing the operation of the piston of the air compressor according to the preferred embodiment of the present invention.
Figure 6:
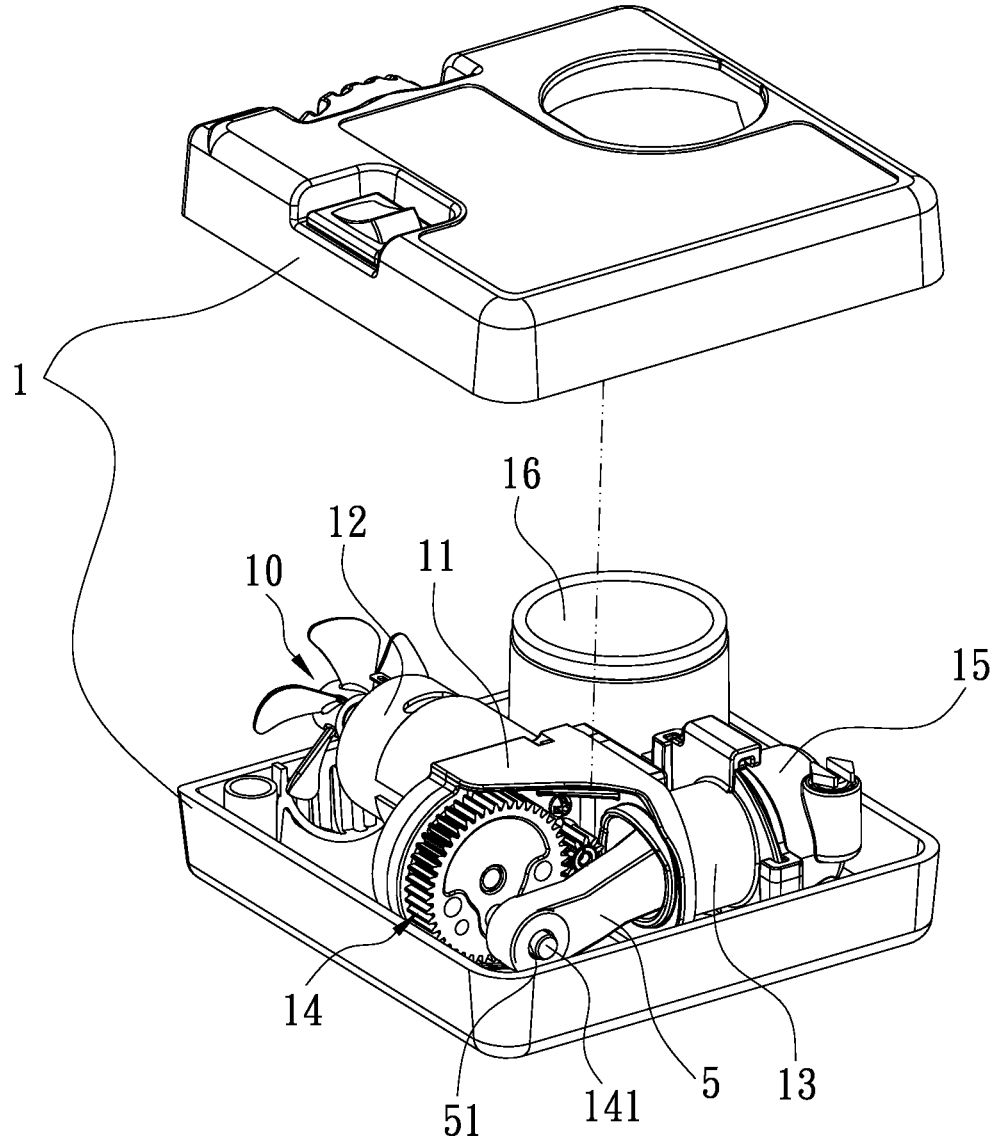
FIG. 6 is a perspective view showing the exploded components of the air compressor according to the preferred embodiment of the present invention.

With reference to FIG. 6, an air compressor 10 according to a preferred embodiment of the present invention is received in an accommodation chamber, a box 1 or other a work place. In this embodiment, as shown in FIG. 6, the box 1 receives the air compressor 10 configured to inflate airs or to connect with a sealant supply (not shown), thus inflating the airs and supplying sealant. The air compressor 10 includes a substrate 11 configured to fix a motor 12, a cylinder 13 connected on the substrate 11, a transmission mechanism 14 mounted on the substrate 11 and connected with a piston. Referring to FIGS. 1 to 7, the piston includes a head 2, a seal ring 24 mounted around an outer wall of the head 2 and configured to close the piston and the cylinder 13 when the air compressor operates, and at least one air orifice 21 defined on a plane 20 of a top of the head 2, wherein a piston rod 5 extends downward from the head 2, and the piston rod 5 includes a circular orifice 51 defined on a bottom thereof and rotatably connected with a crankshaft 141 of the transmission mechanism 14. When an output shaft of the motor 12 actuates the crankshaft 141 of the transmission mechanism 14 to rotate and the piston to move upward and downward in the cylinder 13, the airs are compressed to produce compressed airs, and the compressed airs flow into a storage holder 15 so as to be supplied into a pressure gauge 16 via a delivery pipe, thus displaying a pressure value. Thereafter, the compressed airs are inflated into a deflated object (not shown) via an air hose. Alternatively, the compressed airs and sealant are supplied to a broken tire (not shown) via the air hose or a valve. Since it is well-known art, further remarks are omitted.

Referring to FIGS. 1-5, the plane 20 of the top of the head 2 includes at least one air stop sheet 7 mounted thereon, and a respective one of the at least one air stop sheet 7 includes a positioning zone 71 adjacent to a bending section 70 of the respective one air stop sheet 7, and the bending section 70 is formed in a mechanical working manner, wherein the bending section 70 of the respective one air stop sheet 7 has at least one collapsible guide line 701, and a number of the at least one collapsible guide line 701 and a thickness of a respective one collapsible guide line are determined based on an output power of the air compressor, such that when an external pressure acts to the respective one air stop sheet 7, the respective one air stop sheet 7 opens and closes the piston by using the at least one collapsible guide line (track) 701. The bending section 70 has the positioning zone 71 arranged on a first end thereof and located on the plane 20 of the top of the head 2, and an acting zone 72 arranged on a second end of the bending section 70. The bending section 70 is a boundary line of the acting area 72 and the positioning zone 71 of the respective one air stop sheet 7 so that a positive surface of the respective one air stop sheet 7 (i.e. the respective one air stop sheet 7 facing a top of the cylinder 13 in an upward moving stroke) forms an obtuse angle less than 180 degrees, and a back surface of the acting zone 72 of the respective one air stop sheet 7 backing the top of the cylinder 13 turns on relative to the plane 20 of the top of the head 2 at an open angle θ, thus producing an air flowing space Z. The air flowing space Z is in communication with the at least one air orifice 21 of the head 2 so that when the piston of the air compressor 10 stops, the acting zone 72 of the respective one air stop sheet 7 turns on relative to the at least one air orifice 21 of the head 2, and the at least one air orifice 21 of the piston is communicated smoothly so that a pressure of the cylinder 13 balances with atmosphere, and the piston is not stopped by an additional resistance (i.e. a back-pressure resistance) in the upward moving stroke after the air compressor 10 is opened again.

Figure 7:
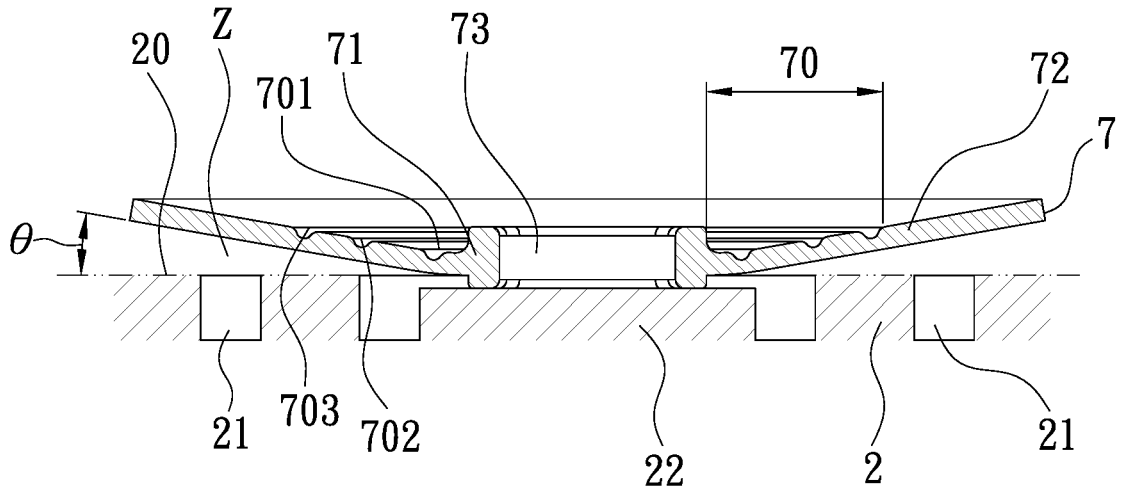
FIG. 7 is another amplified cross sectional view showing the assembly of a part of the piston of the air compressor according to the preferred embodiment of the present invention.

As show in FIG. 7, the plane 20 of the top of the head 2 includes an air stop sheet 7 mounted thereon, and the air stop sheet 7 includes the positioning zone 71 adjacent to the bending section 70 of the air stop sheet 7, wherein the bending section 70 is formed in the mechanical working manner, and the bending section 70 of the air stop sheet 7 has the at least one collapsible guide line 701, wherein a number of the at least one collapsible guide line and a thickness of a respective one collapsible guide line are determined based on an output power of the air compressor, and the at least one collapsible guide line is a first collapsible guide line 701, a second collapsible guide line 702, and a third collapsible guide line 703 are formed on the first bending section 71, such that when the external pressure acts to the air stop sheet 7, the air stop sheet 7 opens and closes the piston by using the at least one collapsible guide line (track) 701. With reference to FIGS. 1-5, the plane 20 of the top of the head 2 includes an air stop sheet 7 mounted on a central axis thereof, the air stop sheet 7 includes a circular bending section 70 formed adjacent to a center thereof, and the positioning zone 71 arranged within a radius of the circular bending section 70, the acting zone 72 arranged outside the radius of the circular bending section 70, wherein the back surface of the acting zone 72 of the air stop sheet 7 backing the top of the cylinder 13 turns on relative to the plane 20 of the top of the head 2 at the open angle θ, thus producing the air flowing space Z. The positioning zone 71 of the air stop sheet 7 has a polygonal hole 73 defined therein, and the head 2 has a polygonal protrusion 22 corresponding to and connected with the polygonal hole 73, wherein a nut 25 is fitted on a column 23 which extends from a top of the polygonal protrusion 22 so that the air stop sheet 7 is fixed on the head 2 securely. The top of the head 2 further has multiple air orifices 21 spaced and surrounding adjacent to the plane 20 of the top of the head 2, passing through the head 2, and communicating with the air flowing space Z, such that when the piston moves in the upward moving stroke (as illustrated in FIG. 5), the acting zone 72 of the air stop sheet 7 closes the multiple air orifices 21. When the piston moves in a downward moving stroke and stops (as shown in FIG. 4), the acting zone 72 of the air stop sheet 7 opens the multiple air orifices 21, residual pressures of the cylinder above the head 2 is discharged via the air flowing space Z so that a pressure of the cylinder 13 balances with atmosphere.

Thereby, the air stop sheet 7 includes the bending section 70, the bending section 70 of the air stop sheet 7 has the at least one collapsible guide line 701, the bending section 70 of the air stop sheet 7 has the positioning zone 71 arranged on the first end thereof, and the acting zone 72 arranged on the second end of the bending section 70 so that the back surface of the acting zone 72 of the air stop sheet 7 backing the top of the cylinder 13 turns on relative to the plane 20 of the top of the head 2 at the open angle θ, and the plane 20 of the top of the head 2 further has at least one air orifice 21 defined thereon, such that the air flowing space Z is in communication with the at least one air orifice 21 so that the pressure of the cylinder 13 balances with atmosphere, and the piston is not stopped by an additional resistance (i.e. the back-pressure resistance) in the upward and downward moving strokes and move in the cylinder smoothly after the air stop sheet 7 moves again.

Figure 8:
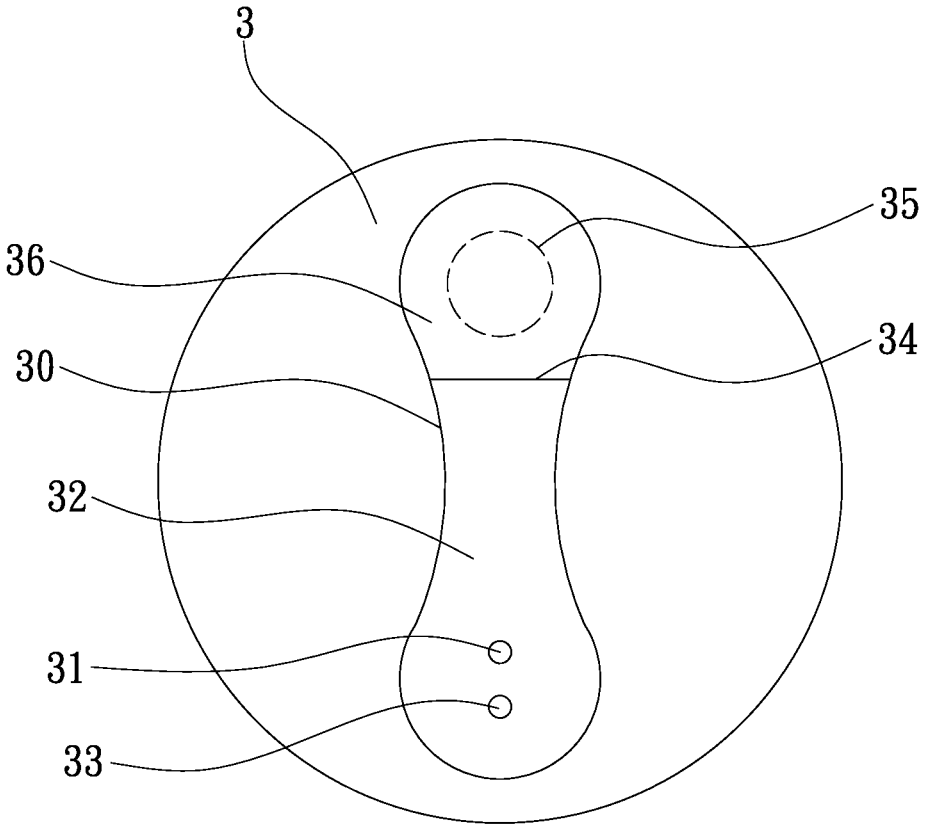
FIG. 8 is a plane view showing the assembly of a piston and an air stop sheet of an air compressor according to another preferred embodiment of the present invention.

With reference to FIG. 8, in another embodiment, two fixing bolts 31, 33 are configured to fix a plane 3 of a top of the head in a positioning zone 32 of an air stop sheet 30, the air stop sheet 30 includes a bending section 34 and an acting zone 36 opposite to the bending section 34 and configured to cover an air orifice 35, and a back surface of the acting zone 36 of the air stop sheet 3 turns on relative to the plane 3 of the top of the head at an open angle θ, thus producing an air flowing space Z.

Figure 9:
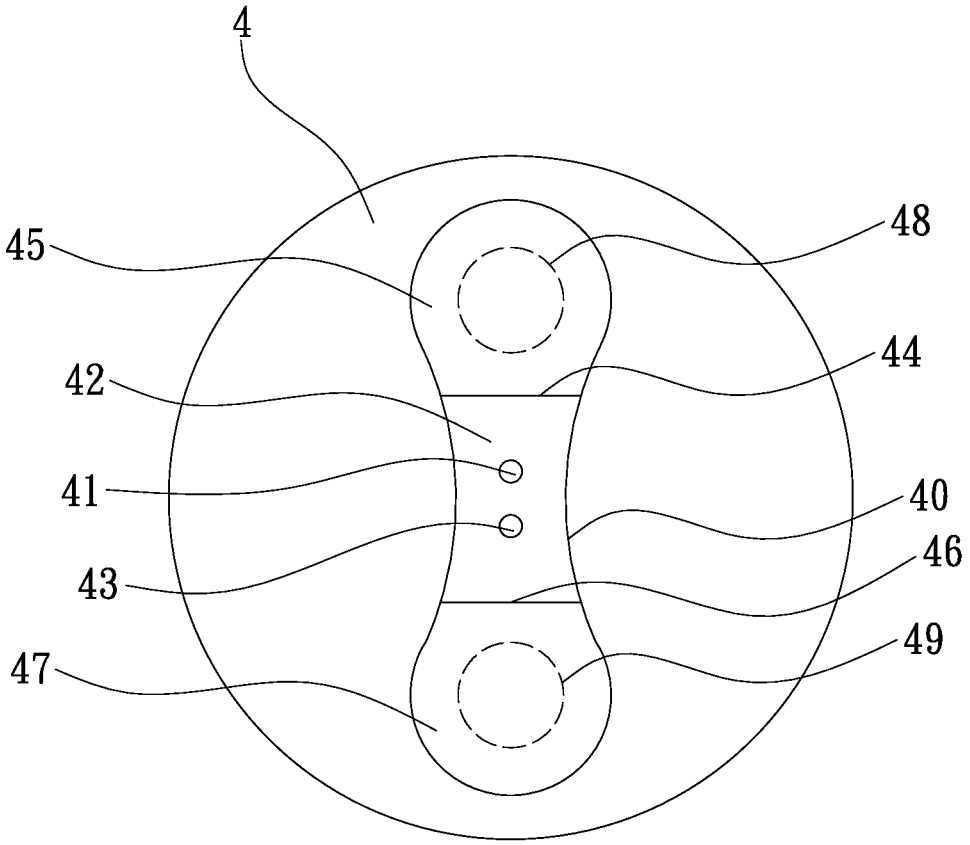
FIG. 9 is a plane view showing the assembly of a piston and an air stop sheet of an air compressor according to another preferred embodiment of the present invention.

Referring to FIG. 9, in another embodiment, two fixing bolts 41, 43 are configured to fix a plane 4 of a top of the head in a positioning zone 42 of an air stop sheet 40, the air stop sheet 40 includes a first bending section 44 and a second bending section 46 which are formed on two outer sides of the positioning zone 42, and the air stop sheet 40 includes a first acting zone 45 and a second acting zone 47 which are arranged opposite to the first bending section 44 and the second bending section 46 and are configured to cover a first air orifice 48 and a second air orifice 49 of the head, wherein back surfaces of the first acting zone 45 and the second acting zone 47 of the air stop sheet 4 turn on relative to the plane 4 of the top of the head at an open angle θ, thus producing an air flowing space Z.

Figure 10:
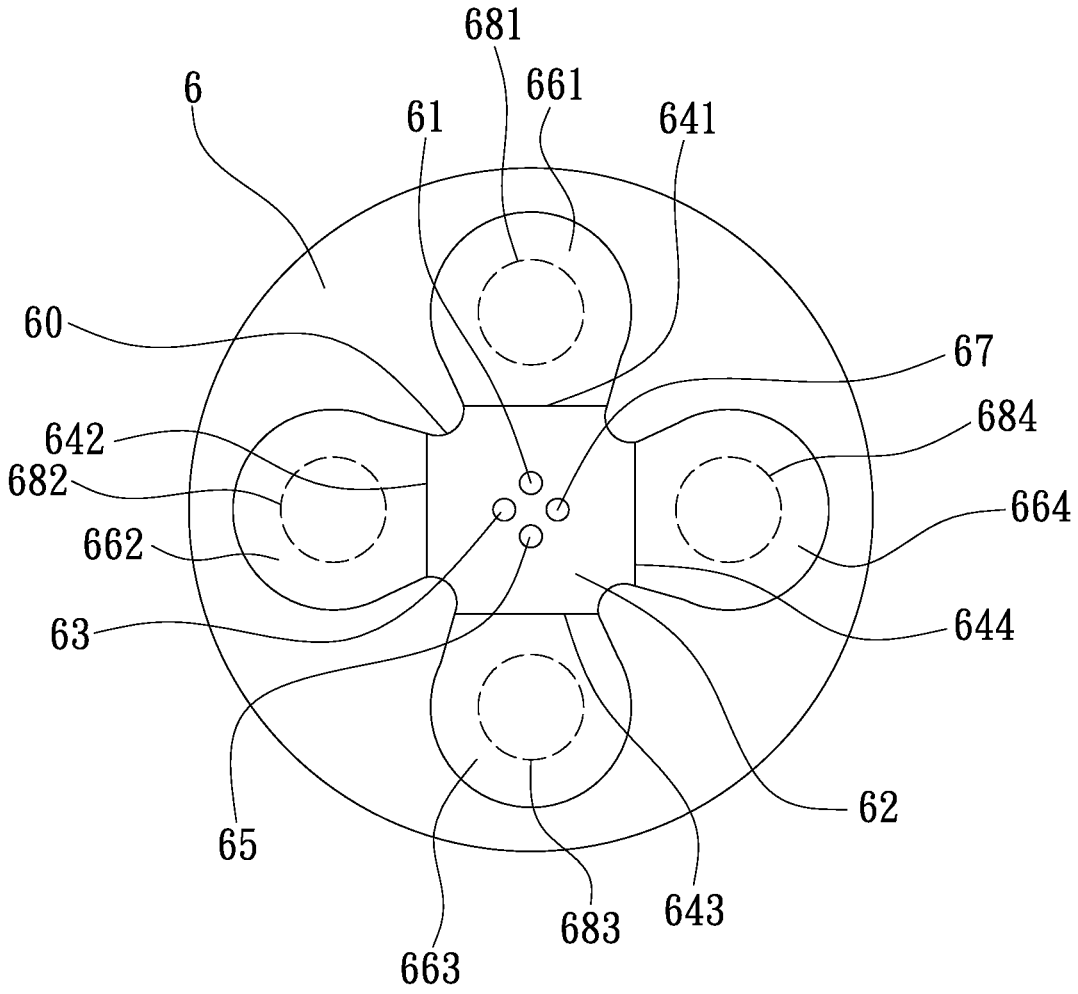
FIG. 10 is a plane view showing the assembly of a piston and an air stop sheet of an air compressor according to another preferred embodiment of the present invention.

As shown in FIG. 10, in another embodiment, four fixing bolts 61, 63, 65, 67 are configured to fix a plane 6 of a top of the head in a positioning zone 62 of an air stop sheet 60, the air stop sheet 60 includes a first bending section 641, a second bending section 642, a third bending section 643, and a fourth bending section 644 which are formed on four outer sides of the positioning zone 62, and the air stop sheet 60 includes a first acting zone 661, a second acting zone 662, a third acting zone 663, and a fourth acting zone 664 which are arranged opposite to the first bending section 641, the second bending section 642, the third bending section 643, and the fourth bending section 644 and are configured to cover a first air orifice 681, a second air orifice 682, a third air orifice 683, and a fourth air orifice 684 of the head, wherein the back surfaces of the first acting zone 661, the second acting zone 662, the third acting zone 663, and the fourth acting zone 664 of the air stop sheet 6 turn on relative to the plane 6 of the top of the head at an open angle θ, thus producing an air flowing space Z.

Figure 11:
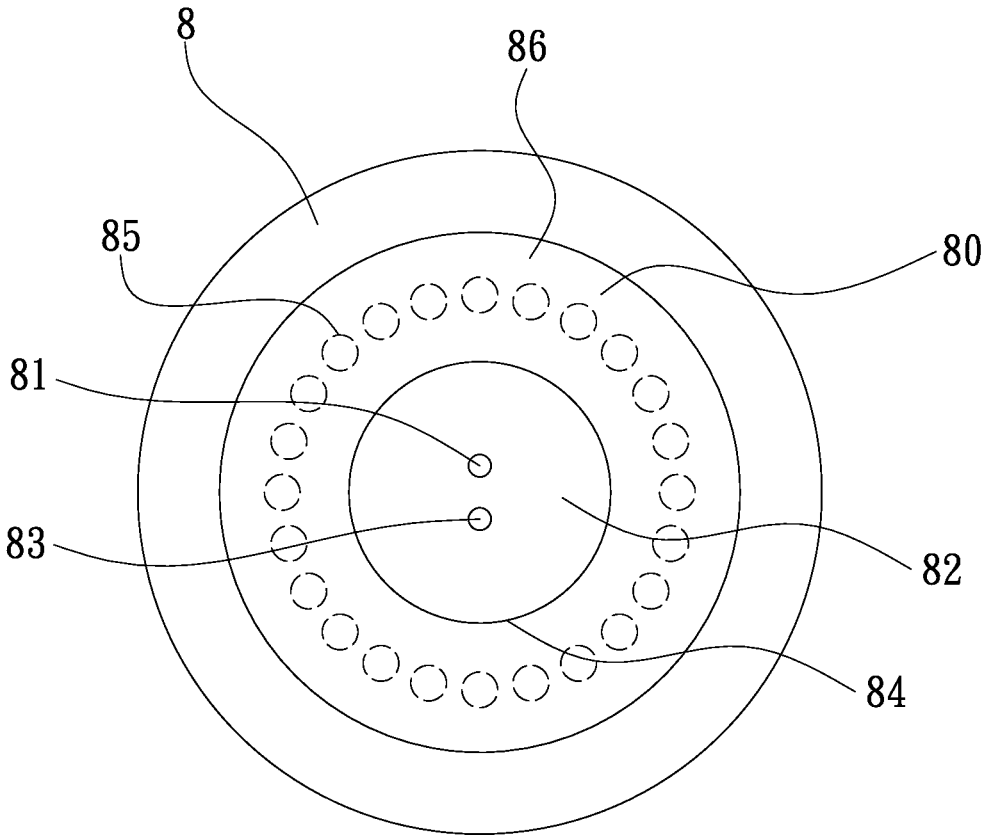
FIG. 11 is a plane view showing the assembly of a piston and an air stop sheet of an air compressor according to another preferred embodiment of the present invention.

With reference to FIG. 11, in another embodiment, two fixing bolts 81, 82 are configured to fix a plane 8 of a top of the head in a positioning zone 82 of an air stop sheet 80, the air stop sheet 80 includes a circular bending section 84 and an acting zone 86 opposite to the bending section 84 and configured to cover multiple air orifices 85, and a back surface of the acting zone 86 of the air stop sheet 80 turns on relative to the plane 8 of the top of the head at an open angle θ, thus producing an air flowing space Z.

Figure 12:
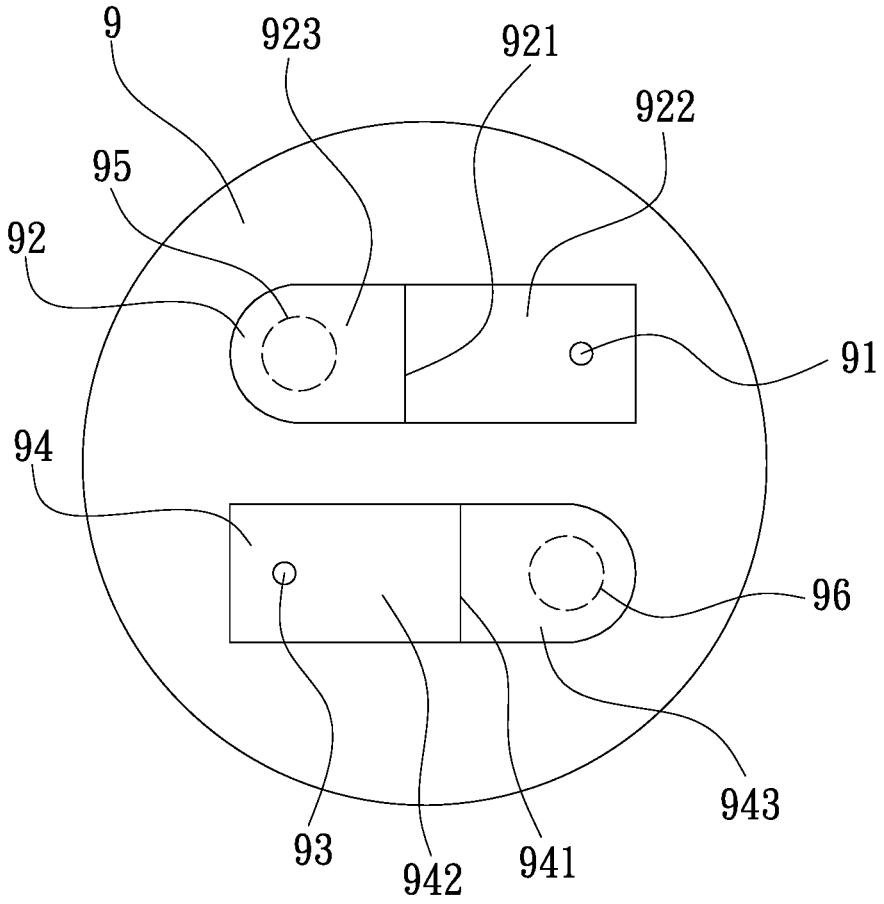
FIG. 12 is a plane view showing the assembly of a piston and an air stop sheet of an air compressor according to another preferred embodiment of the present invention.

With reference to FIG. 12, in another embodiment, two fixing bolts 91, 92 are configured to fix a plane 9 of a top of the head in a first positioning zone 922 of a first air stop sheet 92 and a second positioning zone 942 of a second air stop sheet 94, the first air stop sheet 92 includes a first bending section 921 and a first acting zone 923 opposite to the first bending section 921 and configured to cover a first air orifices 95, the second air stop sheet 94 includes a second bending section 941 and a second acting zone 943 opposite to the second bending section 941 and configured to cover a second air orifices 96, wherein a back surface of the first acting zone 923 of the first air stop sheet 92 turns on relative to the plane 9 of the top of the head at an open angle θ, and a back surface of the second acting zone 943 of the second air stop sheet 94 turns on relative to the plane 9 of the top of the head at the open angle θ, thus producing the air flowing space Z.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A piston of an air compressor comprising at least one fixing bolt configured to fix a plane of a top of a head of the piston to at least one air stop sheet;

wherein a respective one of the at least one air stop sheet includes at least one bending section and at least one acting zone around the at least one bending section and configured to cover at least one air orifice, and a back surface of the at least one acting zone of the respective one air stop sheet of the at least one air stop sheet moves away from the plane of the top of the head to form an open angle θ when the piston of the air compressor stops, thus producing an air flowing space; and wherein a pressure of a cylinder balances with an atmosphere outside the compressor, and the piston is not stopped by a back-pressure resistance to move smoothly in upward and downward moving strokes after the respective one air stop sheet of the at least one air stop sheet moves again.

2. The piston of the air compressor as claimed in claim 1, wherein the bending section of the respective one air stop sheet of the at least one air stop sheet has at least one bendable portion.

3. The piston of the air compressor as claimed in claim 2, wherein a number of the at least one bendable portion is determined based on an output pressure and an airflow volume of the air compressor.

4. The piston of the air compressor as claimed in claim 1, wherein the plane of the top of the head includes the respective one air stop sheet of the at least one air stop sheet mounted on a central axis thereof, the respective one air stop sheet of the at least one air stop sheet includes the at least one bending section comprising a circular bending section formed adjacent to a center thereof, a positioning zone arranged within a radius of the circular bending section, the at least one acting zone comprising an acting zone arranged outside a radius of the circular bending section, wherein the back surface of the acting zone of the respective one air stop sheet of the at least one air stop sheet facing a top of the cylinder moves away from the plane of the top of the head at the open angle θ, thus producing the air flowing space; and the air flowing space is in communication with at least one air orifice of the head so that a pressure of the cylinder balances with atmosphere, and the piston is not stopped by a back-pressure resistance in the upward and downward moving strokes after the respective one air stop sheet of the at least one air stop sheet moves again.

5. The piston of the air compressor as claimed in claim 4, wherein the top of the head further has multiple air orifices spaced around the plane of the top of the head.

6. The piston of the air compressor as claimed in claim 4, wherein the positioning zone of the respective one air stop sheet of the at least one air stop sheet has a polygonal hole defined therein, and the head has a polygonal protrusion corresponding to and connected with the polygonal hole, wherein a nut is fitted on a column which extends from a top of the polygonal protrusion so that the respective one air stop sheet of the at least one air stop sheet is fixed on the head securely; when the piston of the air compressor stops, the acting zone of the respective one air stop sheet of the at least one air stop sheet moves away from the at least one air orifice of the head.

7. The piston of the air compressor as claimed in claim 1, wherein two fixing bolts are configured to fix a plane of a top of the head in a first positioning zone of a first air stop sheet and a second positioning zone of a second air stop sheet, the first air stop sheet includes a first bending section and a first acting zone opposite to the first bending section and configured to cover a first air orifices, the second air stop sheet includes a second bending section and a second acting zone opposite to the second bending section and configured to cover a second air orifices, wherein a back surface of the first acting zone of the first air stop sheet turns on relative to the plane of the top of the head at an open angle θ, and a back surface of the second acting zone of the second air stop sheet turns on relative to the plane of the top of the head at the open angle θ, thus producing the air flowing space.

* * * * *